US006308677B1

(12) United States Patent
Bohach et al.

(10) Patent No.: US 6,308,677 B1
(45) Date of Patent: Oct. 30, 2001

(54) OVERHEAD ROTARY VALVE FOR ENGINES

(76) Inventors: William Louis Bohach; Christopher Scott Bohach, both of 9 Twiggs La., Savannah, GA (US) 31411

( * ) Notice: Subject to any disclaimer, the term of this patent is extended or adjusted under 35 U.S.C. 154(b) by 0 days.

(21) Appl. No.: 09/431,489

(22) Filed: Nov. 2, 1999

Related U.S. Application Data

(60) Provisional application No. 60/116,433, filed on Jan. 20, 1999.

(51) Int. Cl.[7] ..... F01L 7/00

(52) U.S. Cl. ..... 123/190.1; 123/190.8

(58) Field of Search ..... 123/190.8, 190.17, 123/190.16, 190.5, 190.4, 190.1

(56) References Cited

U.S. PATENT DOCUMENTS

| | | | |
|---|---|---|---|
| 1,213,873 | | 1/1917 | Hollmann . |
| 3,948,227 | * | 4/1976 | Guenther . |
| 4,016,840 | | 4/1977 | Lockshaw . |
| 4,019,487 | | 4/1977 | Guenther . |
| 4,077,382 | | 3/1978 | Gentile . |
| 4,119,077 | | 10/1978 | Vallejos . |
| 4,198,946 | | 4/1980 | Rassey . |
| 4,333,427 | | 6/1982 | Burillo . |
| 4,381,737 | | 5/1983 | Turner . |
| 4,517,938 | | 5/1985 | Krüger . |
| 4,751,900 | | 6/1988 | Ruffolo . |
| 5,372,104 | | 12/1994 | Griffin . |
| 5,579,730 | | 12/1996 | Trotter . |
| 5,878,707 | | 3/1999 | Ballard . |

OTHER PUBLICATIONS

MF Spotts, Design of Machine Elements, 1961, pp. 294–325 Prentice Hall Inc. Englewood Cliffs NJ USA.

Irving H. Shames, Mechanics of Fluids, 1962 pp. 392–408 McGraw Hill Book Co. New York, NY, USA.

Edward F. Obert, Internal Combustion Engines 3rd Ed. 1970, pp. 497–566 & 633–677.

C.R.Westaway & A.W. Loomis, Cameron Hydraulic Data 1977, pp. 1–103–3–107.

* cited by examiner

*Primary Examiner*—Tony M. Argenbright
*Assistant Examiner*—Katrina B. Harris
(74) *Attorney, Agent, or Firm*—William Louis Bohach; Christopher Scott Bohach

(57) ABSTRACT

An overhead rotary valve fitted into a cylinder head with diametrical polygonal openings formed therein for use in combination with an internal combustion engine, driven to bring intake and exhaust ports into and out of alignment with passages leading to and from the combustion chamber. Sleeve bearings are fitted in the cylinder head that provide surface sealing, and annular sealing members prevent the air/fuel mixture or exhaust gases from flowing into regions intermediate ports and individual cylinders. Utilizing this overhead rotary valve and associated seals and bearings increases the efficiency and performance of an internal combustion engine. The overhead rotary valve rotating, at one quarter the speed of the crankshaft, minimizes wear and noise levels, self cleans the ports, allows the engine to operate at higher rpm and imparts proper opening and closing of passages at the proper sequence of valve timing without concern of valve float. The instant invention removes the need for reciprocating intake and exhaust valves, camshafts, rocker arms, lifters, push rods, valve guides and retainers, and other related hardware for actuation, significantly increasing the reliability and effectiveness of the internal combustion engine, while reducing overall manufacturing costs.

14 Claims, 4 Drawing Sheets

OVERHEAD ROTARY VALVE FOR ENGINES

CROSS-REFERENCE TO RELATED APPLICATION

This application claims the benefit of the provisional application U.S. Ser. No. 60/116433 filed Jan. 20, 1999.

STATEMENT REGARDING FEDERALLY SPONSORED RESEARCH OR DEVELOPMENT

Not applicable

REFERENCE TO A MICROFICHE APPENDIX

Not applicable

1. Background of the Invention

The present invention relates broadly to internal combustion engines and, more particularly relates to a rotary valve assembly with improved sealing, seals and bearings.

Considerable effort has been spent in development of rotary valve arrangements for internal combustion engines. This effort has been reasonable because of the basic inefficiency of reciprocating or poppet valves that have been almost exclusively utilized for such engines. The poppet valve, quite similar to a stop check valve, in operation substantially interferes with fluid flow in that the valve head is in the flow path of the gases resulting in streamline distortion that significantly reduces and restricts the fluid flow, into or out of a cylinder. Furthermore, mechanical actuation of poppet valves accomplished by depressing the valve stem by a rocker arm and/or a cam, represents an additional energy loss in view of the numerous components that are necessary for operation. While a cam in cylinder head of the engine eliminates the push rods that are otherwise required, the cam does include levers and springs for maintaining the valves in a closed position. The levers and springs require expenditure of a certain amount of energy for operation that further reduces engine efficiency. This type of engine valve is disadvantageous due to its higher of manufacturing cost which results primarily from the assortment of components required for the valve and its actuation. Additionally this valving system has limitations on speed and endurance.

Rotary valve engines are generally recognized as variations on conventional internal combustion engines. Rotary valves have advantages over poppet valve arrangements, which exceed those of the most sophisticated multi-valve poppet arrangements. Because rotary valves have unhindered flow, thus enhance the power output of the engine, they offer a full port to the combustion chamber, instead of a port partially blocked by a poppet valve, which obstructs the flow, induces a pressure drop, and reduces intake and exhaust flow efficiencies. To provide the same power output with tappet valves, due to higher friction and flow coefficients, it would be necessary to provide as many as four inlet valves per cylinder.

Rotary valve systems, known to have been developed for internal combustion engines are either comprised of elongated tubes that connect with several cylinders or disc-type valve elements disposed in each cylinder. Neither of these tapes of rotary valve mechanisms have been found to be as effective or as efficient as desired or possessing sufficient advantages over the reciprocating valves.

There is a need in the art for a rotary valve engine that does not leak and provides exemplary service. There is also a need in the art for a rotary valve engine that is capable of being manufactured more economically.

2. Description of the Prior Art

A rotary valve engine is another previously known valving in which a cylindrical valve member is mounted within the engine housing in the fuel intake or exhaust passage means for the engine cylinders. Through bores are provided through the cylindrical valve member so that upon rotation, in synchronization with the crankshaft and pistons, the valve members permit fluid flow through the intake or exhaust passage means via the through bore at preselected rotational positions of the valve member. This valve train is more simple, in that there are fewer moving parts.

Despite the advantages of those rotary valves, such valving systems do not have widespread use or acceptance in the industry. One reason for this is that those rotary valves, and particularly the exhaust portions, are subjected to high temperatures from the engine cylinders and tend to warp when overheated. Warpage of the rotary valve not only disables the engine, but also requires a more expensive overhaul.

A further disadvantage of those previously known rotary valves is that the valves must be placed in precision bearings designed for higher temperature. The bearings are expensive, and are required to withstand the normal engine operating temperatures to which the rotary valve is subjected.

A still further disadvantage of those previously known rotary valves is that the sealing means has been known for inadequately sealing those rotary valve to the engine housing particularly after long usage. As a result, those types of rotary valve suffer from fluid leakage around the valves, which causes engine compression loss and intake blowback.

Examples of rotary valve engine patents include Lockshaw U.S. Pat. No. 4,016,840 and Guenther U.S. Pat. No. 4,036,184. Even with those varied and different approaches, a problem with those rotary valve engines, a problem shared with many rotary components, is that of sealing. Those rotary valve engines can leak if the tolerances are loose enough to permit free rotation, yet closer tolerances make the engine seize.

In the case of U.S. Pat. No. 4,517,939. Kruger May 21, 1995, die use of dry seals are being utilized in a rotary valve arrangement for an internal combustion engine, comprising an intake gas passage and an exhaust gas passage a rotary valve, and a plurality of dry-bearing sealing rings retained in grooves surrounding the valve member and axially adjacent to the ports in the valve member, where the dry-bearing sealing rings have an anti-friction material on the sliding surface, that valve arrangement further comprising at least one heat resistant dry surface bearing seal provided between the valve member and the housing in the spaces between the dry-bearing sealing rings so as to inhibit leakage of gases . That arrangement adds to the expense and fragility, of the seals and complexity of manufacturing. The abrasive self-cleaning surfaces can induce metal contamination into the lubricant and contaminate all engine parts.

A proposal to the sealing problem is found in the U.S. Pat. No. 4,119,077, Vallejos, which applies a rather complex mechanism to one of the sealing problems. Those sealing problems can occur between cylinders along the rotary valve members. Sealing problems can occur between the combustion chamber and the valve member itself when the ports in the valve member have rotated out of registry with the port in the cylinder head leading to the combustion chamber. However effective the Vallejos sealing mechanism appears to be, an elaborate mechanism and higher expense are needed to achieve the basic sealing.

Still another rotary valve arrangement is presented in U.S. Pat. No. 5,372,104 issued to Bill E. Griffin, Dec. 13, 1994. That is a valve body that is rotated, and located within a valve sleeve. Sealing members and rings positioned into a valve rotor and which encircle the valve rotor. Only the sealing members and rings contact the inner surface of the valve sleeve and thus prevent the valve rotor from contacting the valve sleeve. The sealing members are biased by springs to assure that the sealing members maintain contact with the inner surface of the valve sleeve. Those requires more parts, manufacturing processes and further complex methods of sealing.

The present invention is differentiated from the previously referred to rotary valve configurations in that it is comprised of a single valve spool, (although individual spools can be used for intake and exhaust) and it does employ a commercially available, minimally oil lubricated, sintered metal antifriction valve sleeve with a coating of polytetrafluoroethylene (PTFE) on the bearing, that transfers to the valve shaft, lowering the friction and aids in the sealing capability of the spool against the surface seal sleeve bearing. Moreover, this overhead rotary valve provides simplified, effective method of construction, induction, evacuation, and lubrication and with fuel injection, fuel stratification.

Since the instant invention is made with materials those coefficient of thermal expansion is similar to that of the housing (cylinder head), and that the heat is transferred away from the exhaust to the intake and the cylinder head warpage and seizure is eliminated. None of the above inventions and patents taken either singly or in combination, is seen to describe the instant invention as claimed.

DISCLOSURE OF THE INVENTION

It is the overall object or this invention to provide a new and improved overhead rotary valve for an internal combustion engine that minimizes many of the limitations included in previous designs.

Another objective is to provide an overhead rotary valve which employs a simple drive train with the ports manufactured into the valve shaft as compared to the more complex valve train arrangements such as those with poppet valves.

It is another objective of the present invention to increase flow efficiencies by removing the obstructions from the flow paths of the intake and exhaust gases and to increase the efficiency of the engine.

Additionally, it is an objective of the present invention to provide a simple and effective sealing arrangement for an overhead rotary valve between the combustion chamber and the overhead rotary valve member and the flow passages.

It is another objective of the present invention to provide effective sealing along the length of the overhead rotary valve member intermediate the cylinders and the internals of the engine.

In the prior art as described above, in order to seal off the defined surface areas in the axial and the radial directions, various complex methods of sealing are provided. In the present invention, the overhead rotary valve assembly includes a cylinder head, a rotary valve spool, drive and bearings, seals and associated lubrication which provides simple, effective sealing, with a minimum lubrication required, between the adjacent regions of the valve spool and housing, while permitting an appropriate clearance between those elements to assure free rotation of the valve member. The overhead rotary valve spool is made of a material with appropriate thermal coefficient of expansion and heat transfer capability so as to minimize variations in the clearance between the cylinder head and the valve spool over the operating temperature range.

The cylinder head, with a plurality of upper and lower gas passageways, has a bore for containing the overhead rotary valve spool, surface seal sleeve bearings and annular seals and passages for coolant and lubricating oil to pass through. The head and valve spool are separable so access to the associated parts is not hindered.

The overhead rotary valve spool is cylindrical and extends the length of the cylinder head. The spool has two ports for each combustion chamber (the unit can also be designed for using a dual overhead rotary valve assembly of this type). Rotation of the spool open and closes each port with the proper timing of the crankshaft. The ports are polygonal in shape. The shape controls the duration in which the ports are open and the volume of fluid flow. Configuring the ports so as to keep the ports open longer accomplishes the same effect as larger valves or cams with longer lift duration while the detriments of flow obstructions are not encountered.

The overhead rotary valve is urged to rotate in the cylinder head due to mechanical power transmission from the crankshaft of the engine through timing belts and sprockets or the like. Sintered metal, PTFE coated commercially available bearings provide support and sealing for the valve spool and act as valve bodies in conjunction within the cylinder head.

The alignment of the ports in the overhead rotary valve member is brought about with passages in the cylinder head to provide air/fuel mixture into the cylinder and to evacuate exhaust gases in a timed sequence. The passages leading to and from the combustion chamber are at a maximum distance from each other so as to provide the longest path between the intake and exhaust passages, reducing the potential for crossover flow. The ports of the valve member communicating with the intake and exhaust passages of the housing are nearly diametrically opposed leading to the combustion chamber, making a sealing gap to be the maximum length possible.

Since the overhead rotary valve is not reciprocating, impact forces of reciprocating valves on the valve seats and valve components are not present since there is no change of direction in valve movement, thus making rotary valve engines smoother and more quiet in operation than poppet valve engines. Also, the overhead rotary valve provides higher RPM performance because the overhead rotary valve does not rely on springs to close a poppet valve, which, at high RPM, can lag behind the piston. This is particularly applicable in the case of ineffective or weak valve springs, causing valve float, which the overhead rotary valve overcomes. The rotary will eliminate engine damage from valve ingestion. Additionally, making the combustion chamber less tall, since there are no poppet valve projecting into the combustion chamber, can raise compression ratios without interference.

BRIEF DESCRIPTION OF THE DRAWINGS

A preferred embodiment of the invention will be described hereinafter with reference to the accompanying drawings, in which:

FIG. 3 is taken along the lines A—A of FIG. 1 and looking in the direction of the arrows with the piston at a second position being at the beginning of the exhaust stroke with the piston being near bottom dead center (BDC); FIG. 4, taken along the lines A—A of FIG. 1 and looking in the direction of the arrows with the piston at a first position being the early portion of the intake stroke with the piston being just past top dead center (TDC).

REFERENCE NUMERALS IN THE DRAWINGS

Figure 1:
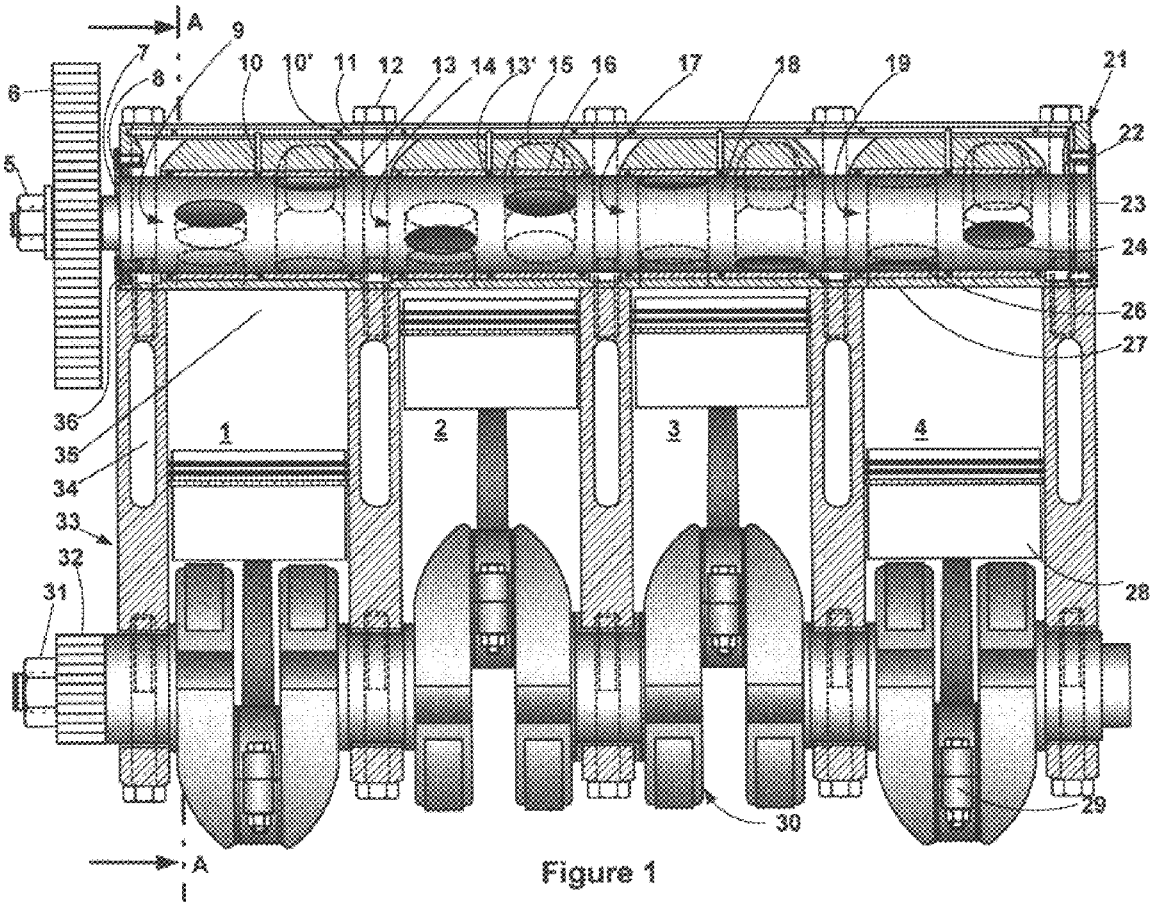
FIG. 1 is a vertical sectional view of the relevant portion of a four-cylinder reciprocating piston internal combustion engine illustrating an embodiment of the invention.

1. #1 cylinder
2. #2 cylinder
3. #3 cylinder
4. #4 cylinder
5. Driven sprocket retaining nut
6. Driven sprocket
7. Rotary valve front retainer plate
8. Rotary valve front retainer screws
9. $1^{st}$ valve segment
10. Oil supply tube
10'. Oil supply orifice
11. Oil distribution tube
12. Cylinder head bolts
13. Oil seal
13'. Intermediate oil seal
14. $2^{nd}$ valve segment
15. Upper exhaust passage
16. Surface seal support sleeve bearing
17. $3^{rd}$ valve segment
18. Overhead rotary valve spool
19. $4^{th}$ valve segment
20. Upper intake passage
21. Cylinder head
22. Rotary valve rear retainer screws
23. Rotary valve rear retainer plate
24. Rotary valve spool exhaust ports
25. Lower exhaust passage
26. Rotary valve spool intake ports
27. Lower intake passage
28. Pistons
29. Connecting rods
30. Crankshaft
31. Driver sprocket retaining nut
32. Driver sprocket
33. Engine block
34. Coolant passages
35. Combustion chamber
36. Rotary valve end seal
37. Spark plug
38. Cylinder head access cover screws
39. Cylinder head access cover

DETAILED DESCRIPTION OF THE PREFERED EMBODIMENTS

Turning now to the figures and specifically FIG. 1, an internal combustion engine with an overhead rotary valve spool 18 is illustrated and includes a traditional engine block 33. It should be noted from the outset that the engine the crankshaft and engine block, as well as the electrical, lubrication and fuel systems are conventional, thus showing the compatibility of the present invention to various applications.

In the embodiment shown in the drawings, a four-cylinder engine is used to typify. Cylinders, 1, 2, 3 and 4 in the engine block 33 together with pistons 28 form the combustion chambers 35. The combustion chambers 35 are blocked off at the top by the cylinder head 21. The cylinder head 21 and engine block 33 contain a plurality of cooling passages 34. The cooling passages 34 are arranged so that they partially encompass a rotary valve spool 18. The rotary valve spool is mounted in lubricated sleeve bearings 16 in the cylinder head 21 and retained in the cylinder head 21 by retainer plates 7 and 23 secured by bolts 8 and 22 respectively. The sprocket 6 that is secured to the spool 18 by the nut 5 rotates the valve spool 18. The spool 18 and sprocket 6 is mechanically driven by the crankshaft 30 with sprocket 32 retained by nut 31. Power is transmitted through a cogged timing belt (not shown) at a speed of 1:4 of the rotational speed of the engine. The lip seal 36 seals the rotary valve spool 18 from external elements and is used to retain lubricant in the engine.

Figure 2:
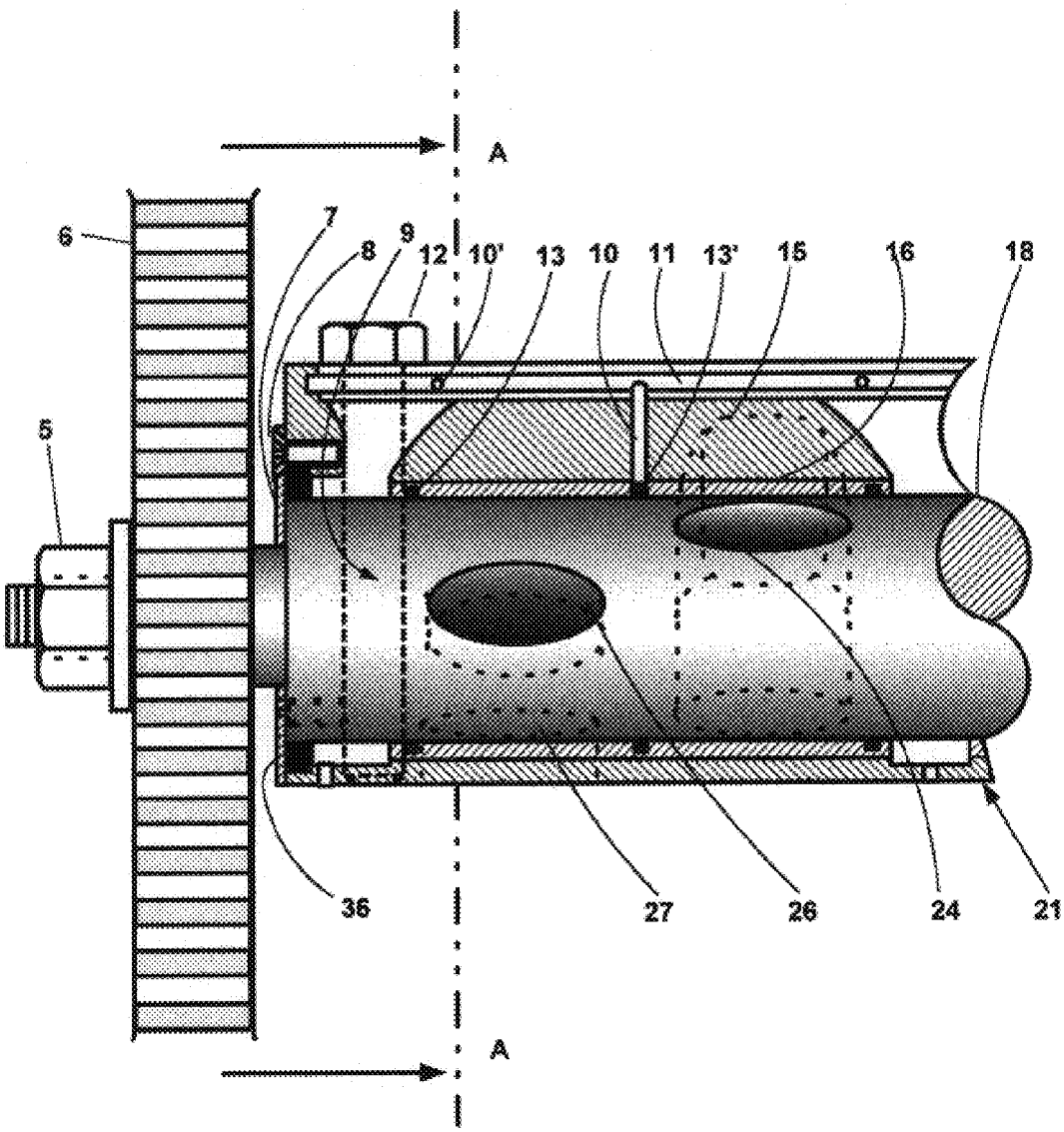
FIG. 2 is an enlarged vertical view of Section 9 of the internal combustion engine illustrated in FIG. 1 illustrating an embodiment of the invention.

As seen in FIG. 1 and FIG. 2, exhaust ports 24 and intake ports 26 have an elliptical cross section. Said ports can have any polygonal cross-section that will provide the desired fluid flow characteristics determined by:

Friction loss=$h_L$,

Resistance coefficient=K,

Average velocity if ft per second=V

Gravitational constant=g=32.174 ft/sec$^2$

And flow area as required by desired operating characteristics. To determine the friction loss, the formula $h_L$=K $V^2/2$ g is applicable. The K value is ~11 times greater for a poppet valve being in the range of 4.2 to 5.4, than the rotary valve with a range of 0.38–0.49. This shoes to achieve the same flows, a larger valve or more valves are required to provide the same flow as a rotary valve.

Considering flow tile construction of the rotary, valve spool 18. It is divided longitudinally into four sections 9, 14, 17, and 19, each associated with cylinders 1, 2, 3, and 4 respectively . The sections 9, 14, 17, 19 are identical in structure, so in the following descriptions, only section 9 will be described in detail. Section 9 of the valve spool 18 contains a supply or intake port 26 for air/fuel induction and an outlet or exhaust port 24 for evacuation of exhaust gases generated by the combustion of the air/fuel mixture ignited by the spark plug 37.

In operation, in FIG. 1 the present invention, aside from the valve train, operates as a conventional internal combustion engine. The air/fuel mixture is periodically inducted into the cylinders and combustion chamber 35. According to a predetermined timing sequence, the spark plug 37 fires igniting the air/fuel mixture and driving the piston 28 don, under the force expanding gases of the combustion. Then, due to the eccentric nature of the crankshaft 30, the piston moves upward as other pistons are driven downward to evacuate the exhaust gases from the combustion chamber and cylinder. Rotation of the crankshaft 30 also causes rotation of the valve spool 18 in accordance with the predetermined timing sequence.

Figure 3:
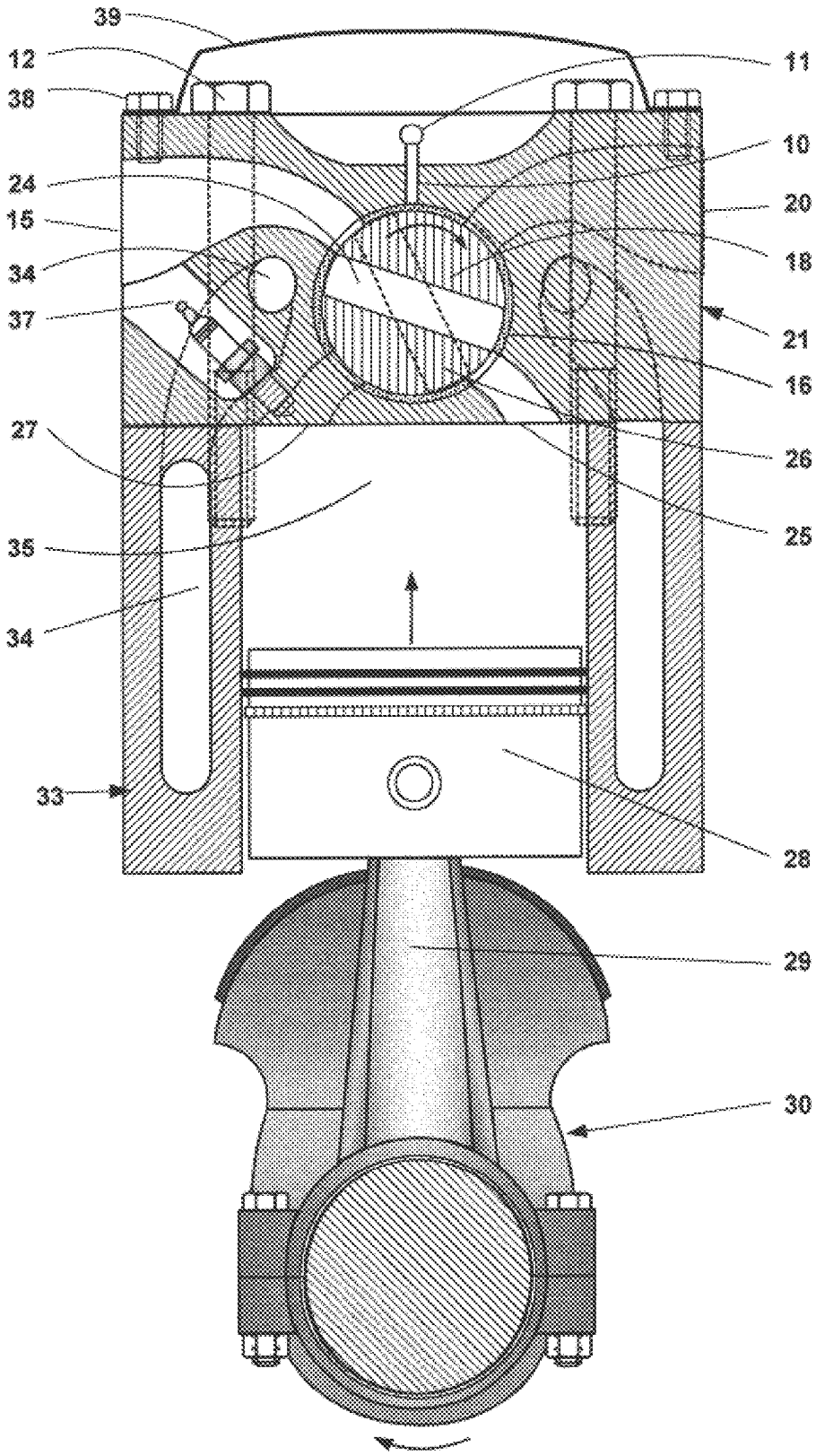
FIG. 3 is a cross-sectional view of the embodiment shown in FIG 1.

In FIG. 3. the rotational position of the valve spool 18 is shown. As the piston begins its ascent on the exhaust stroke, the lower exhaust passage 25 is being brought into communication by way of the exhaust port 24, at a predetermined angle on the crankshaft with the upper exhaust passage 15 where an exhaust manifold (not shown) is attached. The Exhaust port then closes at a predetermined angle on the crankshaft.

Figure 4:
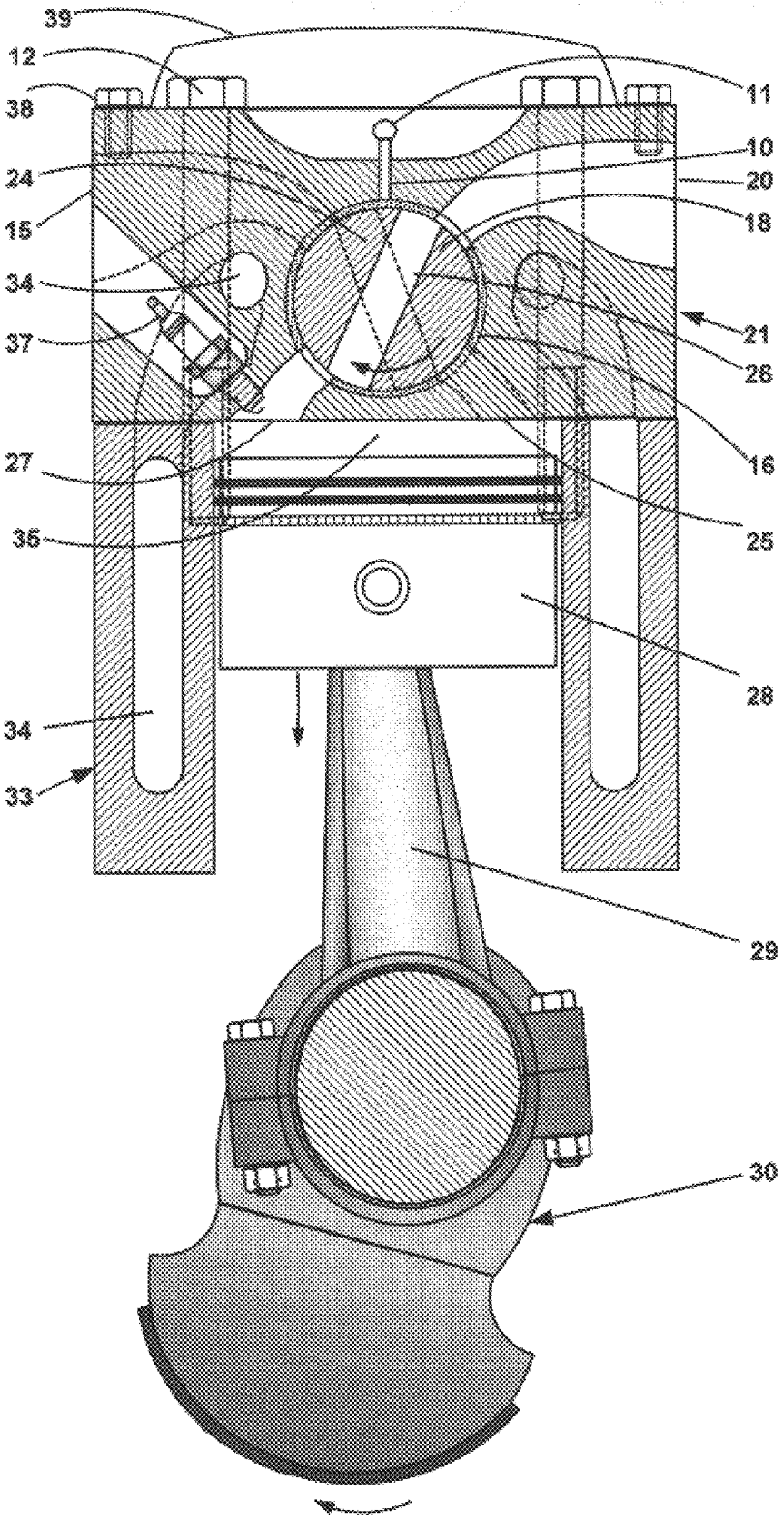
FIG. 4. is a cross-sectional view of the embodiment shown in FIG. 1.

In FIG. 4. the intake port 26 at a predetermined angle on the crankshaft, again depending upon design requirements, is beginning to registers with the upper intake passage 20 and with the lower intake passage 27, as the piston descends on its intake stroke. In just a few more degrees of rotation of the valve spool 18, air/fuel mixture will begin to be supplied to the cylinder and combustion chamber 35. If fuel injection is used, a late injection can perpetrate a stratified charge.

In accordance with the invention, a sealing means is provided in certain regions of the rotary valve spool 18. Here also, because the sections 9, 14, 17, 19 are identical, the description will be limited to section 9.

As shown in FIG. 1 and FIG. 2, three low friction annular gas sealing rings 13 and 13 are mounted in corresponding circumfrential grooves in the surface seal sleeve bearing 16. To ensure low friction, the sliding surfaces of said sealing rings are made of a high temperature, low coefficient of friction elastomer. The seals 13 and 13' are afforded lubrication provided eternally be a flooded supply from aperture 10' in distribution tube 11 and internally from supply tube 10 which is attached to the distribution tube 11. Said seals are also capable of non-lubricated operation for extended periods with no detriment. As is shown in FIG. 1 and FIG. 2, the sealing rings, in this embodiment, are slightly, compressed in the retaining grooves in the surface seal sleeve bearings 16 that are fitted into bores in the cylinder head 21. Said seals are commercially available from Seal Science.

The function of said sealing rings 13 and 13' is to prevent passage of any air/fuel mixture or exhaust gases to the crankcase or adjacent passages and to prevent lubricant from entering the gas passages. Said sealing rings 13 and 13' are arranged to ensure that even though there is differences in gas pressures between the intake and the exhaust, there will not be any leakage.

This function is performed in conjunction with the surface seal sleeve bearing 16 that is constructed from a sintered metal with a steel shell and a polytetrafluoroethylene (PTFE) coating to permit non lubricated operation. These types of bearings, DU® self-lubricating bearings, are commercially available from Garlock Bearings. The sleeve bearing 16 are located in the cylinder head as mentioned above and as shown in FIGS. 1, 2, 3, and 4. Additionally the surfaces of the valve spool 18 are coated with PTFE transferred from the adjacent surface of the sleeve bearing 16. So as to form a matching fit and help prevent seizure of the valve spool 18 in the cylinder head 21. The clearance between the valve spool 18 and the sleeve bearings is the thickness of the oil film used to provide lubrication. During the compression and combustion phase of engine operation, the higher pressure gases force, through the lower exhaust passage 25 and the lower intake passage 27, the blind portion of the valve spool 18 against the upper intake passage 20 and the upper exhaust passage 15, blocking any peripheral leakage. The sealing effect of the surface seal support bearing 16 depends upon the clearance when the engine is in operation, therefore it is desirable to provide liquid cooling of the block 33 and head 21 through the passages 34 surround encompass the rotary valve spool 18.

It is also important to select a material for the valve spool 18 with a coefficient of thermal expansion very close to that of the cylinder head 21. This will maintain the proper oil clearance and prevent seizure. Suitable materials are alloy steels carbon steel, cast iron, ceramics or ceramic composites. Additionally, to improve heat transfer in the valve spool 18, a thin film of lubricating oil is injected into the sleeve bearing 16 via supply tube 10. Furthermore some or the heat is transferred from tile exhaust port 24 to the intake port 26, aiding in further vaporization of the air fuel mixture, as well as to the oil flush from the supply aperture 10'.

By the above the present invention provides an improved internal combustion engine having an overhead rotary valve with a simple, yet effective sealing method preventing the escape of the intake and exhaust gases.

Those persons skilled in the art will therefore readily understand that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Correspondingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude air such other embodiments, adaptations, variations, modifications and equivalent arrangements, the present invention being limited only by the claims appended hereto and the equivalents thereof. Examples of another embodiment would be indexing and or electronic positioning of the rotary valve to allow it to have full port opening during the intake or exhaust cycles.

We claim:

1. An overhead rotary valve assembly and a cylinder head that operates with a conventional internal combustion engine block, consisting of a plurality of cylinders and the cylinder head with upper and lower intake gas passages and an upper and lower exhaust gas passages with an overhead rotary valve spool being mounted in the cylinder head for rotation, which has ports or bores for intake and exhaust gases that become aligned with the upper and lower intake passages and the upper and lower exhaust passages in the cylinder head, depending on the angle of rotation and the rotary valve assembly has a plurality of oil-lubricated, surface seal sleeve bearings and annular sealing rings comprised of a low friction fluoropolymer supported by a sinter metal and annular sealing rings being retained in corresponding grooves, that surround said valve spool that are axially adjacent to the ports in the rotary valve member where the overhead rotary valve annular seals provided between the valve member and the cylinder head inhibit encircling leakage of gases there between and the bearings and seals have an anti-friction fluoropolymer material on the sliding surfaces thereof and, the invention in which said rotation further consists of: a driving sprocket, a driven sprocket and a timing belt or a chain, with the driving sprocket being fastened to a crankshaft and the driven sprocket being secured to the one end of the rotary valve member for driving the valve shaft in synchronism with the reciprocation of the pistons in the cylinder.

2. An overhead rotary valve arrangement according to claim 1 includes oil-lubricated sleeve bearings that have a fluorocarbon anti-friction material supported by a sintered metal on the sliding surfaces thereof, supporting the valve member for rotation in the cylinder head and provides a surface seal and said sleeve bearings have grooves for annular sealing rings and polygonal holes to match the rotary valve spool ports or bores.

3. An overhead rotary valve according to claim 2 whereby the surface of the bearing comprises a polytetrafluoroethylene, PTFE, coated sintered metal with a steel backing is the means for either dry or lubricated operation at a rotational speed up to and including 200 feet per minute.

4. An overhead rotary valve assembly according to claim 2, whereby the surface of the bearings and the surface of the rotary member provide the sealing surface and each are coated with polytetrafluoroethylene, PTFE, after run in which helps provide, in conjunction with the lubricant, slidability, there by substantially reducing friction thus internal horsepower requirements.

5. An overhead rotary valve assembly, according to claim 2 where in said sleeve bearing comprises the sealing member in the surface of the valve housing surrounding each of the cylinders passages therein and gas leakage from the ports is minimized in that the gas pressures from compression and combustion force the rotary valve to seat against the bearing surface and the port openings imparting self-sealing on the upper intake and exhaust passages.

6. An overhead rotary valve assembly, according to claim 1, where in at least 3 annular, low friction, heat resistant polymer or elastomer sealing rings are employed to prevent axial gas losses.

7. An overhead rotary valve assembly according to claim 1 whereby said housing and passages and spool are the means for heat transfer capability by surrounding the rotary valve member and bearings.

8. An overhead rotary valve according to claim 1 wherein said rotary valve spool is made from a material consisting of ferrous material, iron alloy, cast iron, aluminum alloy, ceramic, or ceramic composite with a coefficient of thermal expansion such that it is substantially close to that of the cylinder head material of construction to prevent seizure or distortion with in said cylinder head.

9. An overhead rotary valve assembly according to claim 1 such that the rotary valve will aid in the heat transfer away from the exhaust bore to the cooler intake bore as well as through the support bearings thus reducing hot spots in the engine causing pre-ignition.

10. An overhead rotary valve assembly according to claim 1 wherein the diametrical bores can be any polygonal shape from three-sided progressing through to circular or elliptical with the dimensions dependent upon meeting the designed flow requirements.

11. An overhead rotary valve assembly, according to claim 1, such that the rotary valve operating at ¼ crankshaft speed, back flushes and self cleans every other revolution that will reduce carbon and engine deposits build up in the intake bore and the exhaust bore of the rotary spool.

12. An overhead rotary valve assembly according to claim 1 so that the rotary valve reduces flow pressure drop when charging or evacuating the cylinder such that there are no obstructions in the flow path, and the through bores are chamfered so as to form a flow nozzle and aid in flow and reduce sharp edge orifice or entrance effects at partially opened valve positions.

13. An overhead rotary valve assembly according to claim 1 such that the rotary valve port or bore has a venturi effect where an incremental increase in velocity that causes an incremental decrease in pressure, where the dynamic flow pressure of the air/fuel mixture is decreased as the velocity is increased thereby aiding in the further vaporization and dispersion of the fuel and promotes heat transfer from the exhaust bore.

14. An overhead rotary valve assembly according to claim 1 whereby the assembly can be used to improve flow or eliminate complexity in spark ignition engines as well as compression ignition engines, certain two cycle engines, refrigeration units and compressors, where ever poppet valves, reed valves or check valves are used.

* * * * *